United States Patent [19]

Billings

[11] Patent Number: 4,505,695

[45] Date of Patent: Mar. 19, 1985

[54] SHEET DECURLING MECHANISM

[75] Inventor: Philip A. Billings, Fairport, N.Y.

[73] Assignee: Xerox Corporation, Stamford, Conn.

[21] Appl. No.: 485,984

[22] Filed: Apr. 18, 1983

[51] Int. Cl.[3] ..... D21F 7/00

[52] U.S. Cl. ..... 493/459; 162/271

[58] Field of Search ..... 493/459; 162/270, 271, 162/197; 72/134; 101/23, 32; 34/123; 361/212

[56] References Cited

U.S. PATENT DOCUMENTS

| | | | |
|---|---|---|---|
| 1,969,073 | 8/1934 | Hamre | 162/271 |
| 2,012,953 | 9/1935 | Brunner et al. | 162/271 |
| 2,719,562 | 10/1955 | Beegle | 72/134 |
| 3,971,696 | 7/1976 | Manfredi | 493/459 |

*Primary Examiner*—W. D. Bray

*Attorney, Agent, or Firm*—Bernard A. Chiama

[57] ABSTRACT

A sheet curling/decurling mechanism for decurling copy sheets exiting the fuser apparatus of a copier is disclosed as having a compliant belt of pliable material, a curling roller forming a penetration nip with the compliant belt, the penetration nip being adapted to curl sheets to such an amount as to over curl a sheet leaving the fuser appartus. A decision gate is arranged and shaped to direct the sheet into one of two paths depending upon the degree of over curl. In one path, when slight curl is experienced, a curling device is arranged to compensate for the slight curl. In the other path, when a high degree of curl is present, a curling device is positioned to effect a high degree of reverse curl.

1 Claim, 6 Drawing Figures

SHEET DECURLING MECHANISM

Figure 1:
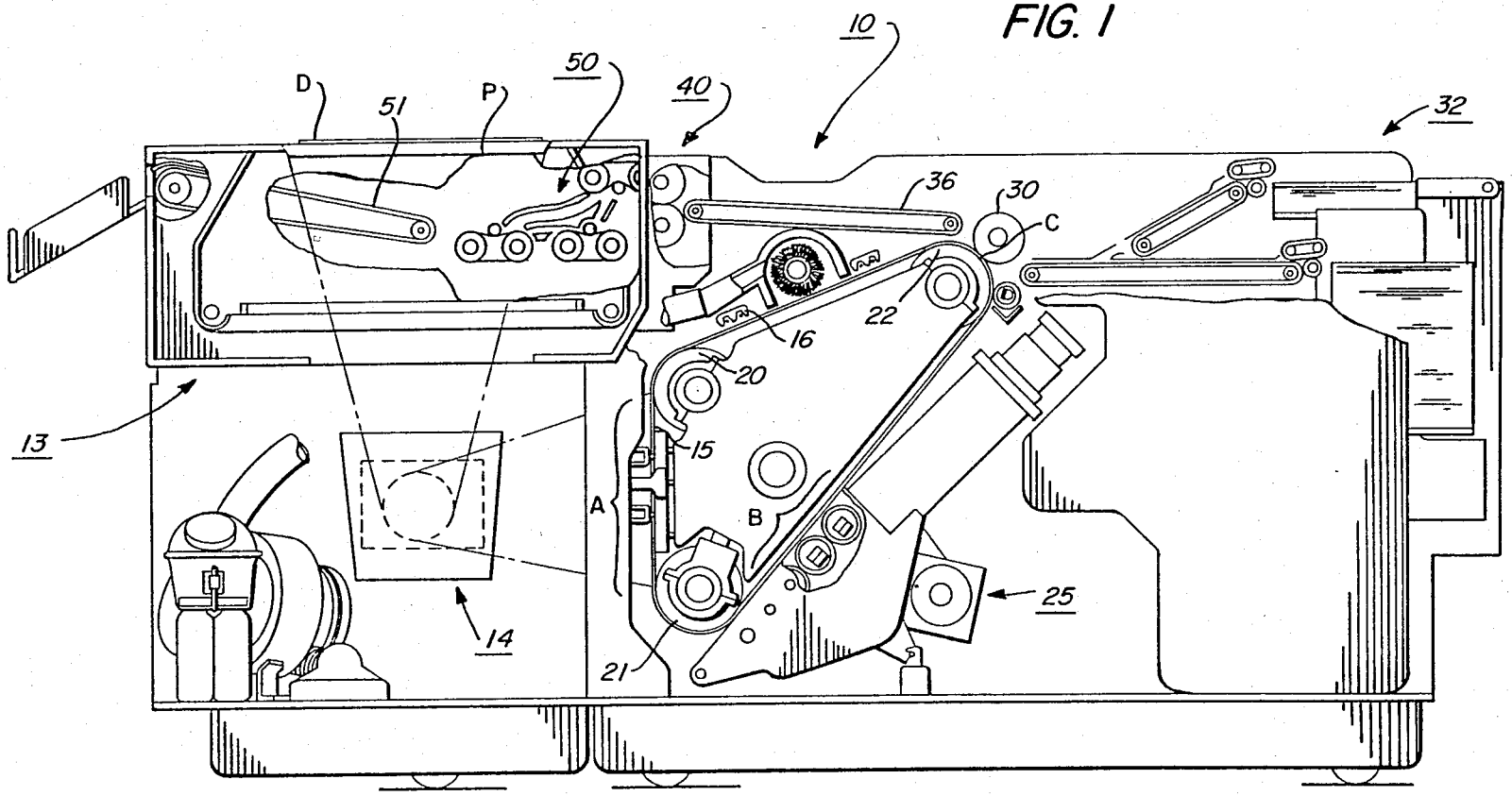

With the advent of high speed copy reproduction machines, such as xerographic copiers, the need for devices to stack, collate, staple and/or bind the finished output has become increasingly important. However, due to the processing steps in reproduction machines, the copy sheets produced by a machine have a curl induced therein by the machine which prevents or seriously hampers proper stacking or collating of the copy machine output. In a xerographic machine of the type wherein a powdered toner image is transferred to the copy sheet and thereafter fused thereto, the application of heat to the image side of the sheet to fuse the toner thereon dries the moisture from one side of the copy sheet. The difference in moisture level between one side of the copy sheet and the other side produces substantial differences in curl in a great variety of copy sheets, particularly those having a high moisture content due to storage at high ambient humidity levels in the copy machine or in the room adjacent the copy machine. Furthermore, for the same ambient conditions and heat output of a fuser apparatus, curl differences will result in accordance with the weight of the copy paper.

While many devices have been utilized in the past to straighten web-like sheet material, the problems of feeding individual cut sheets through decurling mechanisms, which mechanisms must of necessity be adjustable to compensate for varying sheet curl depending upon ambient conditions and sheet characteristics have produced numerous jams and presented great difficulties in obtaining the exact amount of straightening necessary due to the variable curl encountered from day to day and from the use of various papers having a wide range of paper weight and different curl characteristics.

Many existing belt-on-roller decurlers use a roller penetrating a belt to make paper conform to a given radius. Multi-bend decurlers of this type combine single units but suffer problems of jam clearance and large space requirements. An alternative to the belt-on-roller type is the belt-on-belt type decurler but while these require less space, their use results in a larger bending radius and less effective decurling. Furthermore, both of these types of decurlers are limited to the range of paper weights which can be used in a copier. Both light weight paper and the heavy weight paper, the extremes of available paper weight for which a copier may be adapted to process, suffer from inadequate curling compensation in the use of either of the foregoing type decurler.

In U.S. Pat. No. 1,969,073, a sheet straightening mechanism of the belt-on-belt type is disclosed as having two sets of belts and coacting rollers between which sheets are conveyed. In this arrangement, sheets are corrugated for flattening the sheets. In U.S. Pat. No. 2,012,953, a rather complex decurling mechanism of the roller-on-belt type is disclosed so as to subject each sheet to curl alternately in opposite directions. Different size rollers are used to vary the amount of decurling. One adjustable metal forming mechanism is disclosed in U.S. Pat. No. 2,719,562 and comprises a large soft roller and a smaller radius metallic roller embedded within the soft periphery of the large roller. Mechanism is also provided to vary the depth of penetration of the smaller roller to vary the amount of curl to be induced upon a sheet of metal going through the mechanism.

Therefore, it is the principle object of the present invention to permit the more accurate control of the curling or decurling of sheets having a wide range of paper weights.

It is another object of the present invention to control the curling or decurling of sheets more readily and with a minimum of parts and operative steps.

The invention combines a decurling apparatus having a radiused surface, such as a roller, upon and penetrating a belt for a first sheet bend. A fixed decision gate is utilized downstream of the roller/belt nip to route the sheet to any number of subsequent bend devices in accordance with the amount of curl induced on the sheet at the initial roller/belt curling device. The decision gate is designed with a tapered "V" shape thereby being adapted to guide a sheet reliably into either of two paths regardless of the lead edge curl of the sheet. One or more additional sheet bending or curling devices are arranged in either of these two paths.

Figure 2:
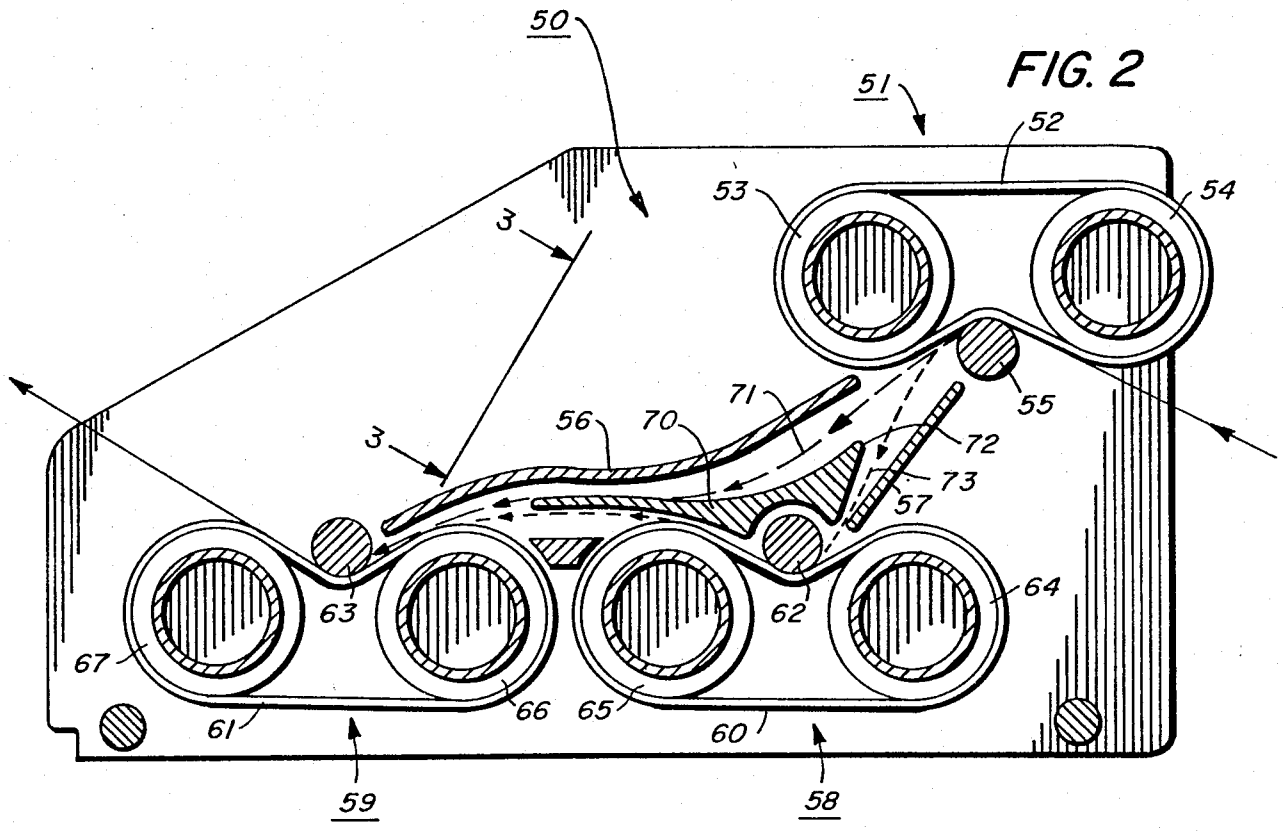
Figure 3:
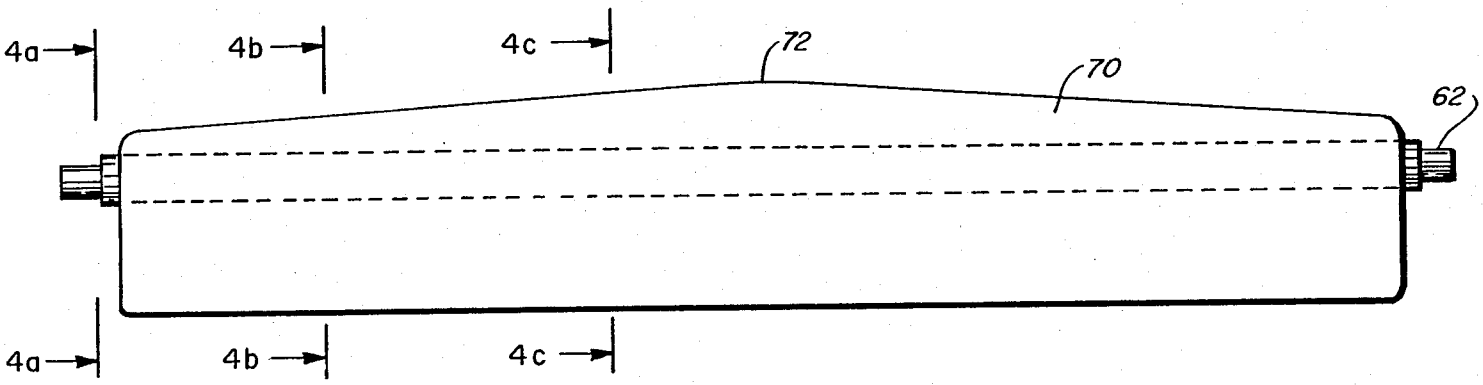
Figure 4A:
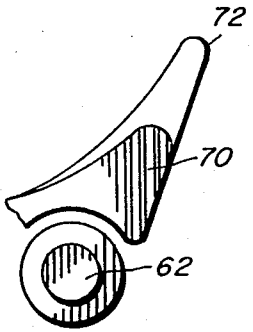
Figure 4B:
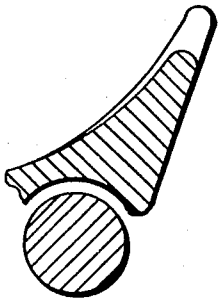
Figure 4C:
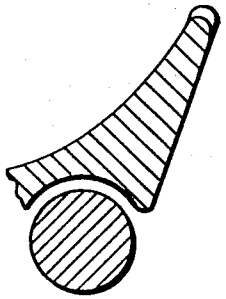

For a better understanding of the invention and further features thereof, reference is made to the following detailed description of the invention to be read in connection with the accompanying drawings wherein:

FIG. 1 illustrates a xerographic reproduction machine employing the sheet decurling mechanism of the present invention;

FIG. 2 illustrates the decurling mechanism of the present invention in operation for decurling a sheet having slight curl and other sheets having much greater characteristics; and FIG. 3 is a plan view of the decision gate utilized in the present invention; and FIGS. 4*a*, 4*b* and 4*c* illustrate three cross sectional views of the gate taken along the lines 4*a*—4*a*, 4*b*—4*b*, and 4*c*—4*c*, respectively in FIG. 3.

For a general understanding of an electrostatic processing system 10 in which the invention may be incorporated as a typical application, reference may be made to FIG. 1. As in all electrostatic systems such as a xerographic machine of the type illustrated, a light image of an original to be reproduced is projected onto the sensitized surface of a xerographic plate to form an electrostatic latent image thereon. Thereafter, the latent image is developed with an oppositely charged developing material comprising carrier beads and smaller toner particles triboelectrically adhering thereto to form a xerographic powder image corresponding to the latent image on the plate surface. The powder image is then electrostatically transferred to a support surface to which it may be fixed by a fusing device whereby the toner image is caused permanently to adhere to the support surface.

In the illustrated machine, an original O to be copied is placed upon a transparent support platen P fixedly arranged in an illumination assembly. While upon the platen, an illumination system 13 flashes light rays upon the original, thereby producing image rays corresponding to the informational areas on the original. The image rays are projected by means of an optical system 14 to an exposure station A for exposing the photosensitive surface of a moving xerographic plate in the form of a flexible, endless photoconductive belt 15. In moving in the direction indicated by the arrow prior to reaching the exposure station A, that portion of the belt being exposed would have been uniformly charged by a corona device 16 located at a belt run extending between belt supporting rollers 20, 21 and 22. The exposure station extends between the roller 20 and the roller 21.

The exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes around the roller 21 and through the developing station B located at a third run of the belt and in which there is positioned a developing apparatus generally indicated by the reference numeral 25. The developing apparatus 25 comprises a plurality of magnetic brushes which carry developing material to the adjacent surface of the upwardly moving inclined photoconductive belt 15. As the developing material is applied to the xerographic belt, toner particles in the development material are attracted electrostatically to the belt surface to form powder images.

The developed electrostatic image is transported by the belt 15 to a transfer station C located at a point of tangency on the belt as it moves around the roller 22 whereat a sheet of copy paper is moved at a speed in synchronism with the moving belt in order to accomplish transfer of the developed image. There is provided at this station a transfer roller 30 which is arranged on the frame of the machine for contacting the non-transfer side of each sheet of copy paper as the same is brought into transfer engagement with the belt 15. The roller 30 is electrically biased with sufficient voltage so that a developed image on the belt may be electrostatically transferred to the adjacent side of a sheet of paper as the same is brought into contact therewith.

There is also provided a suitable sheet transport mechanism adapted to transport sheets of paper seriatim from a paper handling mechanism generally indicated by the reference numeral 32 to the developed image on the belt as the same is carried around the roller 22. A suitable programmer may be operatively connected to the mechanism 32 and the illumination device for producing an electrostatic latent image on the belt 15 is effective to present a developed image at the transfer station C in timed sequence with the arrival of a sheet of paper.

As the sheet emerges from the transfer roller, it is detacked by a suitable corona discharge device. The sheet is thereafter retained with the toner image inverted on the underside of a transport mechanism 36 by suitable means such as vacuum for movement into a heater roller type fuser assembly generally indicated by the reference numeral 40 wherein the developed and transferred xerographic toner image on the sheet is permanently affixed thereto. After fusing, the finished copy is passed through a decurling mechanism 50, to be more fully explained hereinafter and is discharged by way of transport 51 from the apparatus at a suitable point for collection externally of the apparatus.

As shown in FIG. 2, the input end of the decurling apparatus 50 is provided a curling device 51 comprising a belt 52 made from pliable elastomer material suitably fortified with strengthening material and entrained around a pair of relatively large rollers 53, 54. Either of the rollers 53, 54 may be considered the drive means for the belt 52 and is connected to the drive system associated with the roller fuser 40 in order to assure that sheets leaving the fuser and entering the decurler maintain a velocity suitable for decurling activity. The roller 53 may be considered an idler roller being driven by the belt 52 and the drive roller 54.

Positioned adjacent the lower run of the belt 52 is a penetrating roller 55 of a relatively small diameter having its periphery depressing the portion of the belt between its supporting rollers so that the belt becomes wrapped around a portion of the periphery of the roller. The roller 55 is fixedly supported for free rotation on the machine frame for the system 10.

Positioned below the nip of the belt 52 and roller 55 and downstream of the path of movement of sheets exiting the nip, are upper and lower sheet guiding baffles 56, 57 respectively. The baffles 56, 57 guide sheets to one or more additional sheet curling devices indicated by the reference numerals 58, 59. The devices 58, 59 are similar to the curling device 51 in that each comprises a belt 60, 61 and a penetrating roller 62, 63, respectively. Suitable guiding rollers 64, 65, 66, 67 are provided for supporting and driving the belts 60, 61.

As shown in FIG. 2, the upper baffle 56 has a much greater width than the baffle 57 and is arranged to span both of the curling devices 60, 61. Between the baffles 56, 57 is positioned a decision gate 70 which extends for a length, when spread, perpendicular to the plane of the drawing of FIG. 2, to equal approximately the parameter of the sheet, indicated by the dashed arrows, line 71, and measured transverse to the direction of movement of the sheet. The gate 70 is designed with a tapered "V" shape with the point of the "V", illustrated as the edge 72 in FIG. 3, projecting into the path of movement of a sheet exiting the curling device 51. As shown in FIGS. 4*a*, 4*b* and 4*c*, the gate tapers beginning along a transverse line located at the midpoint of the gate and extending toward the ends thereof.

In operation, a sheet of paper after energizing from the fuser assembly 40 possesses some degree of curl depending upon many factors, such as, moisture content of the sheet and the atmosphere, the fusing temperature, paper thickness and weight, transit time through and from the fuser assembly, etc. The curled sheet is directed to the decurler by a suitable guide plate (not shown) and into the nip defined by the roller 55 and the belt 52 of the curling device 51. In moving through this nip, the sheet is curled in the direction opposite that of the curl formation placed on the sheet by the fuser assembly. the amount of curling produced by the roller 55/belt 52 nip exceeds or over curls the curling effect caused by the fuser assembly. This over curling provides a known amount of curling upon the sheet before it enters the decurling portion of the apparatus 50.

If the sheet experiences a slight curl after leaving the roller 55/belt 52 nip, it will follow generally along the arrow line 71 and be guided by the upper surface of the gate as it progresses further through the apparatus 50. In the event the curl is very slight, the leading edge of the sheet will slide along and be guided by the lower surface of the baffle 56. In either event, the sheet is guided upon the belt 61 of the curling device 59 and is directed into the nip of the roller 63 and the belt 61. Travel through this nip places a reverse curl upon the sheet and this curl can be regulated to impose a decurling condition upon the sheet which renders a desired curl effect of the sheet being transported through the machine 10.

In the event the sheet experiences a high degree of curl and follows a path indicated by the dotted arrow line 73, the leading edge of the sheet will be directed by the curl to the space between the lower surface of the gate 70 and the upper surface of the baffle 57. These two surfaces converge and direct the sheet upon the belt 60 of the curling device 58 and into the nip between the roller 62 and the belt 60. Travel through this nip reverses somewhat the nip imposed on the sheet by the roller 55/belt 52 nip and leaves some degree of curl remaining. Such remaining curl is more completely reversed by the curl device 59 which will act upon the sheet leaving the device 58. As shown in FIG. 2, after leaving the device 58, the sheet is directed by the trailing edge of the gate 70 into a path which merges with the path of a sheet which follows the path of the dashed arrow line 71. In this manner, the sheet enters the roller 63/belt 61 nip so that decurling may continue to be imposed upon the sheet.

It will be noted that the angle at which sheets enter the curling nip of the device 58 is greater than the angle sheets enter the nip of the device 59. By virtue of this difference, the device 58 is capable of decurling at a greater degree the curl posed by the device 59 and is suitable to combine with the slight decurling effect of the device 59 to compensate for the curling effect of the device 51.

From the foregoing it will be appreciated that decurling of copy sheets leaving the fusing apparatus of an electrostatographic machine can be accomplished by the use of a fixed decision gate which is arranged and shaped to direct copy sheets in one of two paths depending upon the amount of curl induced upon the sheet after leaving the fusing apparatus. Sheets having only a slight curl after being purposely curled, are directed into a path which effects a slight decurling action and in accordace with the slightness of curl. Sheets having a high degree of curl leaving the initial curling action will be directed into a path which will produce a greater degree of decurling, and in accordance with that degree. The decision gate is shaped in a manner as to guide a sheet reliably in either path, irrespective of differences in lead edge curl of copy sheets. It will all be understood any number of combinations of the number of curling devices such as, 58 and 59 as well as gates 70 may be provided to acquire desired results.

While the invention has been described with reference to the structure disclosed, it is not confined to the details set forth, but is intended to cover such modifications or changes as may come within the scope of the following claims.

I claim:

1. A sheet decurler comprising:

a sheet transport belt supported by at least two rollers for supporting the belt therearound and arranged to receive curled copy sheets from the fusing apparatus of a copier;

a penetrating roller disposed adjacent the belt run between said belt rollers adapted for contact with the outer surface of said transport belt to depress the same to form a nip therebetween, the degree of penetration of said penetrating roller relative to the belt being of an amount of reverse curl induced in a copy sheet fed between said penetrating roller and said belt as the sheet passes therebetween; and a gate positioned downstream of said penetrating roller/belt nip arranged to deflect a sheet of paper into one or another of two paths in accordance with the degree of curl imposed thereon by said roller/belt nip, said one path having a curling device therein arranged to decurl the sheets having slight curl thereon, said other path having a curling device therein arranged to decurl the sheets having a high degree of curl and to combine with the curling device in said one path to complete the decurling of the sheets entering said other path.

* * * * *